US011439884B1

(12) United States Patent
Lynn et al.

(10) Patent No.: US 11,439,884 B1
(45) Date of Patent: Sep. 13, 2022

(54) GOLF GLOVE

(71) Applicants: Richard E. Lynn, Jacksonville, FL (US); Verlaine Lynn, Jacksonville, FL (US)

(72) Inventors: Richard E. Lynn, Jacksonville, FL (US); Verlaine Lynn, Jacksonville, FL (US)

( * ) Notice: Subject to any disclaimer, the term of this patent is extended or adjusted under 35 U.S.C. 154(b) by 17 days.

(21) Appl. No.: 17/068,301

(22) Filed: Oct. 12, 2020

(51) Int. Cl.
*A63B 69/36* (2006.01)
*A63B 71/14* (2006.01)
*A63B 57/60* (2015.01)
*A63B 47/04* (2006.01)

(52) U.S. Cl.
CPC ..... *A63B 69/3608* (2013.01); *A63B 47/04* (2013.01); *A63B 57/60* (2015.10); *A63B 71/146* (2013.01); *A63B 2209/10* (2013.01)

(58) Field of Classification Search
CPC ..... A63B 69/3608; A63B 47/04; A63B 57/60; A63B 71/146; A63B 2209/10
USPC ..... 473/205; 2/159, 160, 161.2, 161.4, 2/161.6, 161.8
See application file for complete search history.

(56) References Cited

U.S. PATENT DOCUMENTS 1,783,788 A * 12/1930 Hatchett, Sr. ..... A46B 5/04 15/160
2,559,788 A * 7/1951 Patterson, Jr. ..... A63B 71/146 2/161.2
3,982,298 A * 9/1976 Ota ..... A47L 23/10 15/106
5,441,355 A 8/1995 Moore
6,098,234 A * 8/2000 Jackson, Jr. ..... A47K 7/02 15/104.94
7,874,020 B1 * 1/2011 Franklin ..... A47L 13/18 2/160
D651,408 S * 1/2012 Farkas ..... D4/116
8,469,619 B1 6/2013 Lewis
9,162,125 B1 * 10/2015 McBryde ..... A46B 5/0008
2002/0010956 A1 * 1/2002 Roland ..... A41D 19/002 2/161.4
2004/0031120 A1 * 2/2004 Cherian ..... A41D 19/0024 15/227
2005/0198758 A1 * 9/2005 Kunz ..... A63B 71/146 15/118
2005/0229284 A1 * 10/2005 Gaetz ..... A42B 3/26 2/159
2007/0152004 A1 * 7/2007 Rooney ..... A63B 55/408 224/576

(Continued)

*Primary Examiner* — Nini F Legesse
(74) *Attorney, Agent, or Firm* — Sanchelima & Associates, P.A.; Christian Sanchelima; Jesus Sanchelima

(57) ABSTRACT

A system for a golfing device including a glove assembly and a brush assembly is disclosed. The glove assembly includes a glove to be worn on a desired hand of a user. The brush assembly includes a brush removably secured to the glove. The brush helps to clean golfing equipment. Additionally, the brush serves as a training aid and helps the user with proper alignment and hand position on a golf club prior to a golf swing. When the user positions their hands on the golf club, the brush aligns with the golf club ensuring that the user has proper hand position on the golf club for a better golf swing due to proper alignment. The brush reinforces proper hand positioning and alignment as the user is instantly aware when the golf club is misaligned.

6 Claims, 3 Drawing Sheets

(56) References Cited

U.S. PATENT DOCUMENTS

| | | | | |
|---|---|---|---|---|
| 2009/0084820 | A1* | 4/2009 | Lortie | A63B 55/408<br>223/78 |
| 2011/0004974 | A1* | 1/2011 | Firouzman | A47L 13/18<br>2/161.8 |
| 2012/0272467 | A1* | 11/2012 | Forbes | A63B 57/60<br>15/114 |
| 2018/0042316 | A1* | 2/2018 | Wiseman | A63B 57/60 |

* cited by examiner

GOLF GLOVE

BACKGROUND OF THE INVENTION

1. Field of the Invention

The present invention relates to a gold glove and, more particularly, to a golf glove with a training aid attached.

2. Description of the Related Art

Several designs for golf gloves have been designed in the past. None of them, however, include a golf glove comprising a small rectangular brush block on the back of the hand for cleaning golf club heads and golf balls wherein the glove also has indicia for aligning the hand on the glove or for proper club alignment during a swing.

Applicant believes that a related reference corresponds to U.S. Pat. No. 5,441,355 for a glove with an attached scrub brush. Applicant believes that another related reference refers to U.S. Pat. No. 8,469,619 for a hand glove comprising integral brush bristles. None of these references, however, teach of a glove with a detachable brush for cleaning of golf equipment and also serving as an indicia or training aid for proper swing alignment.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a golfing device that provide comfort to the user while golfing.

It is another object of this invention to provide a golfing device that includes a brush removably attached for cleansing of golf equipment.

It is still another object of the present invention to provide a golfing device that helps users improve their golf swing by serving as a training aid which reinforces proper swing alignment.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
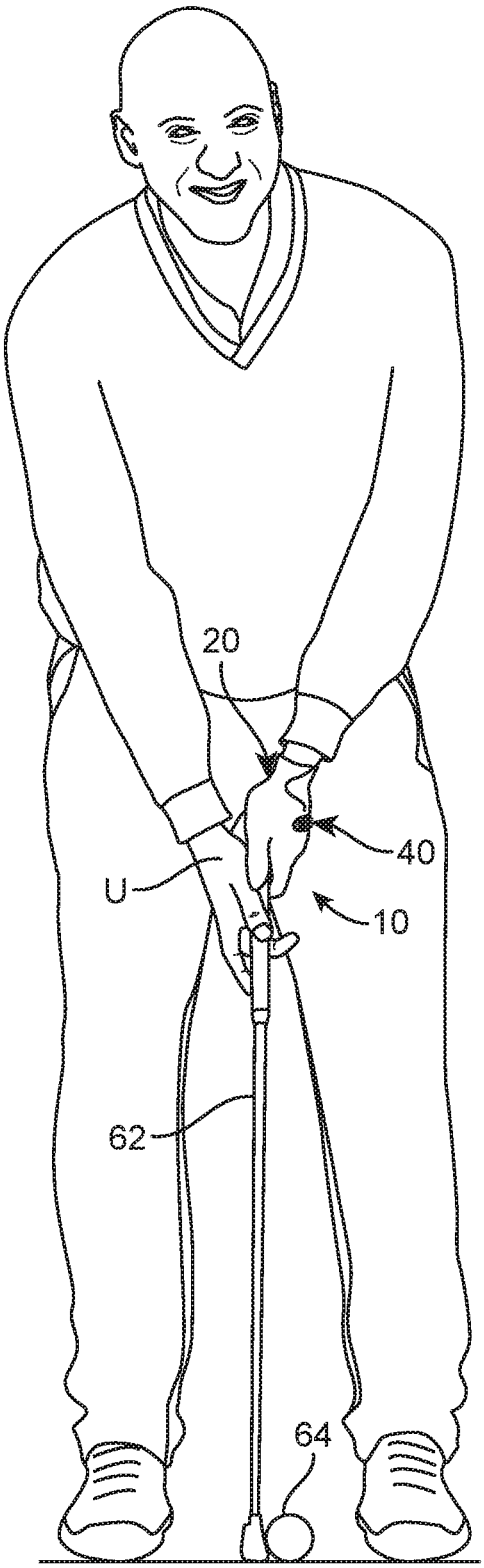
FIG. 1 represents an operational view of a user U wearing and using glove 22 as a training aid for proper swing alignment.

Referring now to the drawings, where the present invention is generally referred to with numeral 10, it can be observed that a golfing device 10 basically includes glove assembly 20 and a brush assembly 40.

Figure 2:
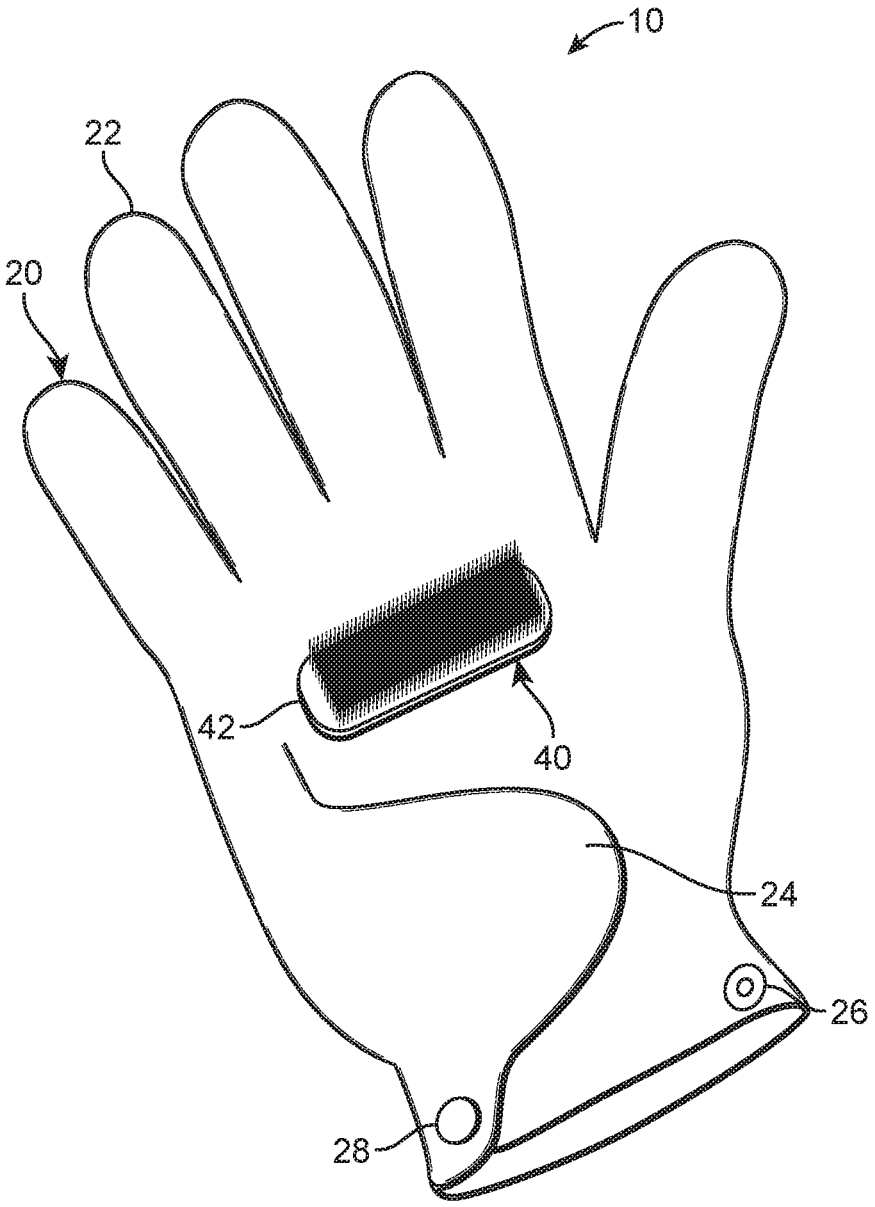
FIG. 2 shows an isometric view of glove 22 with brush 42 attached.
Figure 3:
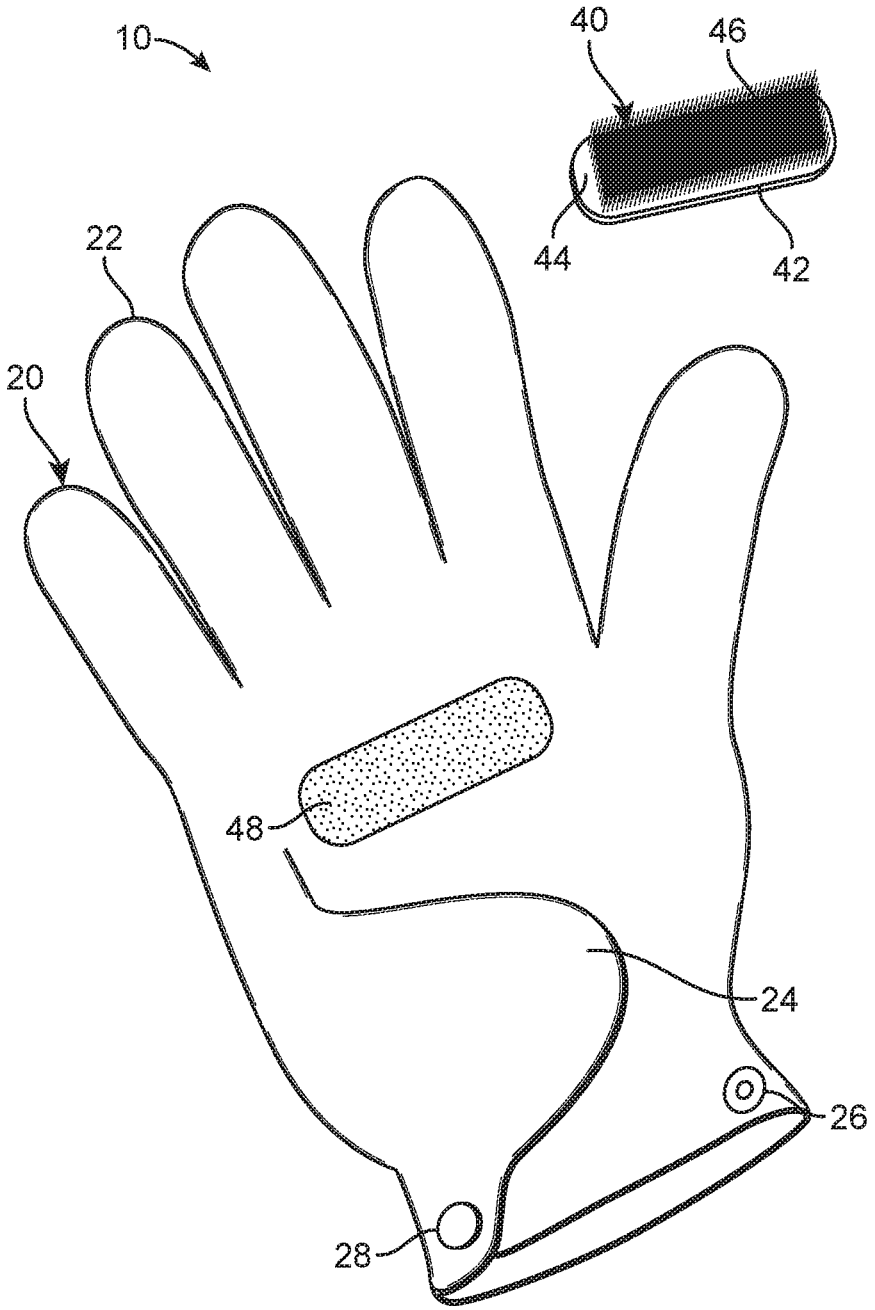
FIG. 3 illustrates an isometric view of glove 22 with brush 42 detached.

Golfing device 10 as best illustrated in FIGS. 1-3, may be multipurpose. Golfing device 10 may help to provide comfort to a user U that is handling golf equipment such as a golf club 62 during golfing. Golfing device 10 may also serve as a training aid to help user U with proper club alignment before and after a golf swing. Proper club alignment is reinforced with golfing device 10 which leads to an improved golf swing and game for user U.

Golfing device 10 may include glove assembly 20, as best shown in FIGS. 1-3. Glove assembly 20 may include a glove 22 to be worn on a hand of user U. Glove 22 may be made of materials such as cotton, wool, neoprene, latex, lycra, or combinations thereof. It is to be understood that glove 22 may be of dimensions that may cooperate with covering the entire hand of user U. In one embodiment, it may be suitable for glove 22 to be padded along a front portion thereof. This helps to provide comfort to user U while grasping a golf club 62.

Glove 22 may include a flap 24 that may be used to secure glove 22 to the hand of user U. In the preferred embodiment, flap 24 may be integral with glove 22. Flap 24 may be secured to glove 22 along a lateral side thereof. Flap 24 may be seen on the rear side of glove 22 having a substantially triangular shape. Flap 24 may be released to permit user U to insert their hand into glove 22 quickly and comfortably. Flap 24 may be adjustable to tighten or loosen securement of glove 22 to user U. Flap 24 may partially overlap glove 22 when secured thereto. It is to be understood extend a partial length of glove 22 across a bottom portion of glove 22. It may be suitable to secure flap 24 to glove 22 with fastening members.

Secured to the bottom portion of glove 22 may be a ring 26. Ring 26 may extend through glove 22. It may be suitable to use ring 26 to attach glove 22 to an object as desired by user U. Ring 26 may help user U to store glove 22 when glove 22 is not in use. Glove 22 may be hung for storage with ring 26.

Additionally, secured to the bottom portion of glove 22 may be a securing member 28. Securing member 28 may be parallel to ring 26. More specifically, securing member 28 may be located on flap 24. Securing member 28 may further help to secure glove 22 to the user. securing member 28 may be a hook and loop fastener, button, snap button, or other suitable fastening means.

Importantly, secured to glove 22 may be brush assembly 40. Brush assembly 40 may include a brush 42. Brush 42 may be used to cleanse golf club 62 or a golf ball 64. Brush 42 may include a base 44 and bristles 46. In one implementation, base 44 may be substantially rectangular. Atop of base 44 may be bristles 46. Bristle 46 may be rigid enough to clean golf club 62 or golf ball 64 thoroughly. Bristles 46 may be perpendicular to base 44. Bristles 46 may be parallel to each other. It is to be understood that brush 42 may be attached to glove 22 at the rear side thereof. In one embodiment, brush 42 may extend horizontally across a partial length of glove 22. It is to be understood that it may be suitable for brush 42 to be secured at a predetermined location on glove 22 with a predetermined orientation. In one embodiment, brush 42 may be detachably secured to glove 22 with fasteners 48. Preferably, fasteners 48 may be hook and loop straps secured to glove 22 and brush 42. However, it is to be understood that other fastening means such as buttons, snap buttons, adhesives, screws or the like may be suitable to secure brush 42 to glove 22.

Brush 42 may serve as an indicium that helps user U improve their golf swing and game. Brush 42 may help user U with proper alignment prior to a golf swing, as best illustrated in FIG. 1. As user U aligns golf club 62 relative to golf ball 64, brush 42 may align perpendicularly with golf club 62 ensuring that user U has proper hand position on golf club 62 for a better golf swing due to proper alignment. Brush 42 reinforces proper hand position and alignment as user U is instantly aware when golf club 62 is misaligned. It is to be understood that before and after a golf swing, brush 42 may be perpendicular to golf club 62 resulting in a T like configuration, when proper alignment is achieved.

Golfing device 10 provides convenience to user U during golf games. Glove 22 helps to protect the hands of user U during golfing. Additionally, glove 22 helps to provide comfort to user U. Brush 42 helps user clean golfing equipment such as golf club 62 or golf ball 64. Brush 42 additionally serves as a training aid that helps user U with proper hand alignment on golf club 62 which leads to a better golf swing.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a golfing device, comprising:

a. a glove assembly including a glove, said glove is configured to entirely cover a hand of a user, said glove includes a flap secured to a lateral side thereof, said flap adjusting a securement of said glove to said user by loosening or tightening the fitting of said glove, said flap has a substantially triangular shape with a rounded top end that configures a concave shape, the glove further includes a securing member located at a bottom end of the flap, wherein said securing member is configured to secure said glove on said hand of the user;

b. a brush assembly including a brush, said brush having a base and bristles, said base having a rectangular shape with rounded corners, the brush is removably attached to a surface of said glove by means of fasteners, said bristles extend outwardly form said base, wherein the bristles are located on a surface of the base which is opposite to a surface that is in abutting contact with said fasteners, said bristles are disposed on a rectangular configuration, said base is disposed horizontally on said glove, said brush is located between said flap and glove fingers, proximal to a thumb of the glove; and c. a golf club and a golf ball, said brush adapted to clean said golf club and said golf ball, said brush is configured to be used as an indicia which indicates a predetermined hand alignment on said golf club, said brush aligns perpendicularly with said golf club.

2. The system of claim 1, wherein said glove further includes a ring, said ring is located at a bottommost end of the glove, said ring has a circular shape, said ring and said securing member are diametrically opposite, said ring permits said glove to be hanged therethrough.

3. The system of claim 1, wherein said brush is removably attached to a rear surface of said glove with fasteners.

4. The system of claim 3, wherein said fasteners are hook and loop straps.

5. The system of claim 1, wherein said brush is entirely above of said flap.

6. A system for a golfing device, consisting of:

a. a glove assembly including a glove, said glove is configured to entirely cover a hand of a user, said glove includes a flap secured to a lateral side thereof, said flap adjusting a securement of said glove to said user by loosening or tightening the fitting of said glove, said flap has a substantially triangular shape with a rounded top end that configures a concave shape, the glove further includes a securing member located at a bottom end of the flap, wherein said securing member is configured to secure said glove on said hand of the user, said glove further includes a ring, said ring is located at a bottommost end of the glove, said ring has a circular shape, said ring and said securing member are diametrically opposite, said ring permits said glove to be hanged therethrough;

b. a brush assembly including a brush, said brush having a base and bristles, said base having a rectangular shape with rounded corners, the brush is removably attached to a surface of said glove by means of fasteners, said bristles extend outwardly form said base, wherein the bristles are located on a surface of the base which is opposite to a surface that is in abutting contact with said fasteners, said bristles are disposed on a rectangular configuration, said base is disposed horizontally on said glove, said brush is located between said flap and glove fingers, proximal to a thumb of the glove, wherein said brush is entirely above of said flap, wherein said fasteners are hook and loop straps; and c. a golf club and a golf ball, said brush adapted to clean said golf club and said golf ball, said brush is configured to be used as an indicia which indicates a predetermined hand alignment on said golf club, said brush aligns perpendicularly with said golf.

* * * * *